United States Patent [19]

Strada

[11] 4,140,348

[45] Feb. 20, 1979

[54] EXCAVATING MACHINE EQUIPPED WITH AN ATTACHMENT FOR SCRAPER ACTIVITY ON WALLS AND VAULTS

[75] Inventor: Edmondo G. Strada, Pecetto-Turin, Italy

[73] Assignee: Societa Italiana Macchine Industriali Torino, S.p.A., Grugliasco (Turin), Italy

[21] Appl. No.: 801,233

[22] Filed: May 27, 1977

[30] Foreign Application Priority Data

May 28, 1976 [IT] Italy ..... 68314 A/76

[51] Int. Cl.[2] ..... E21C 3/00

[52] U.S. Cl. ..... 299/70; 172/705; 173/139; 188/285; 37/2 R

[58] Field of Search ..... 214/142; 172/705, 710; 37/42 VL, 1, 2 R; 188/285; 267/137, 177, 175, 170, 167, 166, 61 R, 60; 173/162, 139; 299/36, 37, 69, 70

[56] References Cited

U.S. PATENT DOCUMENTS

| | | | |
|---|---|---|---|
| 996,997 | 7/1911 | Morris | 267/60 X |
| 2,123,388 | 7/1938 | Viguerie, Jr. | 267/60 X |
| 2,477,748 | 8/1949 | Hutchins | 267/60 X |
| 2,526,500 | 10/1950 | Pilch | 214/142 X |
| 2,850,956 | 9/1958 | Rogers et al. | 172/705 |
| 3,279,105 | 10/1966 | Kolinger et al. | 172/705 X |
| 3,605,905 | 9/1971 | Bo | 172/710 X |
| 3,653,131 | 4/1972 | Pilch | 37/1 |
| 3,749,446 | 7/1973 | Doty | 299/37 |

*Primary Examiner*—Clifford D. Crowder
*Attorney, Agent, or Firm*—August E. Roehrig, Jr.; Harvey W. Rockwell; Robert A. Brown

[57] ABSTRACT

An excavating machine having a work implement or material excavating tool articulated on the free end of a working arm of the excavator to absorb and dissipate high stress impact loading on the working tool incurred during machine operation.

4 Claims, 3 Drawing Figures

EXCAVATING MACHINE EQUIPPED WITH AN ATTACHMENT FOR SCRAPER ACTIVITY ON WALLS AND VAULTS

BACKGROUND OF THE INVENTION

This invention relates in general to excavator machines and, in particular, to an excavator machine especially adapted for the scraping of walls, vaults, or tunnels.

More specifically, but without restriction to the particular use which is shown and described, this invention relates to an excavating machine having an articulately mounted and angularly positionable material excavating tool mounted on the free end of a working arm of the excavator machine and adapted to absorb high stress impacts incurred during excavation.

During the excavation of material, such as encountered in clearing excavation walls, vaults, and tunnels, it is necessary to scrape the walls and ceilings of vaults and tunnels to dislodge rock or loose materials which are not solidly anchored in the surrounding ground and, therefore, present hazards to workmen. In order to loosen such material, an excavating machine is used to scrape the walls and ceilings of the vaults and tunnels and in so doing the excavator is frequently subjected to heavy impact stresses. These impact stresses frequently occur when the scraping portion, or material excavating tool, of the machine loosens material and then is abruptly propelled into the solid material from which the loosened material had become dislodged. The forces applied to the excavator from such impacts frequently are sufficient to lift the front portion of the excavator off the ground, abruptly dropping it back to the ground from the height to which the excavator has been lifted. These violent shocks cause very high stresses in all components of the excavating machine, and frequently result in breaking machine components.

In order to minimize damage to the components of the excavator from such impacts, it is desirable to absorb the impact which occurs during operation. However, the shock absorbing system must permit the material excavating tool to exert a sufficient force for dislodging loosened material. The present invention allows an excavator to function in normal working operation, but absorbs the high stress impact imparted to the working components of the excavator, and dissipates this impact to prevent structural damage to the working components or the excavator itself. While this invention is believed to have general application to any type of equipment wherein it is desirable or necessary to absorb impact loading, for convenience of illustration the preferred embodiment is described with reference to an excavator especially suitable for scraping the walls and ceilings of vaults and tunnels.

SUMMARY OF THE INVENTION

It is, therefore, an object of this invention to improve excavating equipment

Another object of this invention is to absorb impact loading on excavating equipment.

A further object of this invention is to limit the amount of impact loading stress which may be exerted on components of an excavator.

Still another object of this invention is to permit the material excavating tool of excavating equipment to exert a predetermined force, but absorb forces exceeding the predetermined limit.

These and other objects are obtained in accordance with the present invention wherein there is provided an excavating machine having a work implement or material excavating tool articulated on the free end of a working arm of the excavator to absorb and dissipate high stress impact loading on the working tool incurred during machine operation.

DESCRIPTION OF THE DRAWINGS

Further objects of the invention, together with additional features contributing thereto and advantages accruing therefrom, will be apparent from the following description of a preferred embodiment of the invention which is shown in the accompanying drawings wherein like reference numerals indicate corresponding parts throughout.

DESCRIPTION OF THE PREFERRED EMBODIMENT

Figure 1:
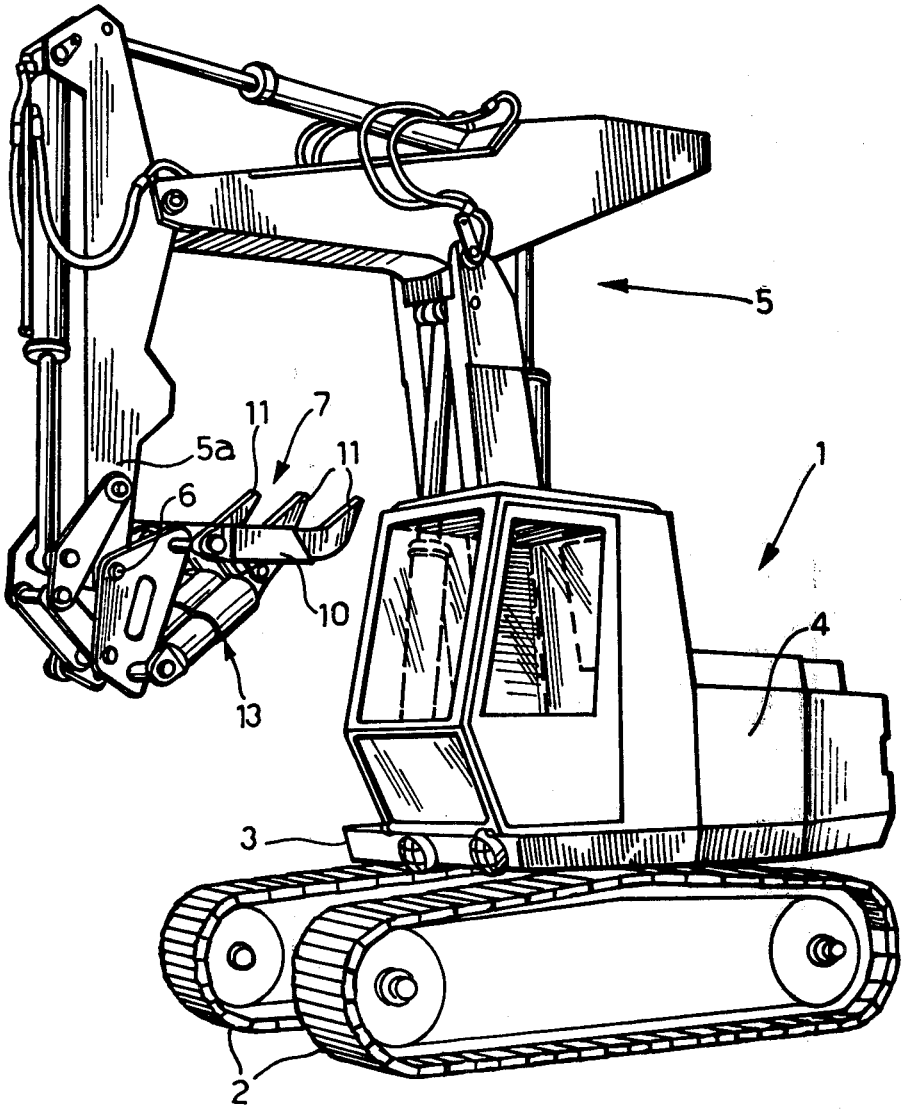
FIG. 1 is a perspective view of an excavating machine constructed in accordance with the present invention.
Figure 2:
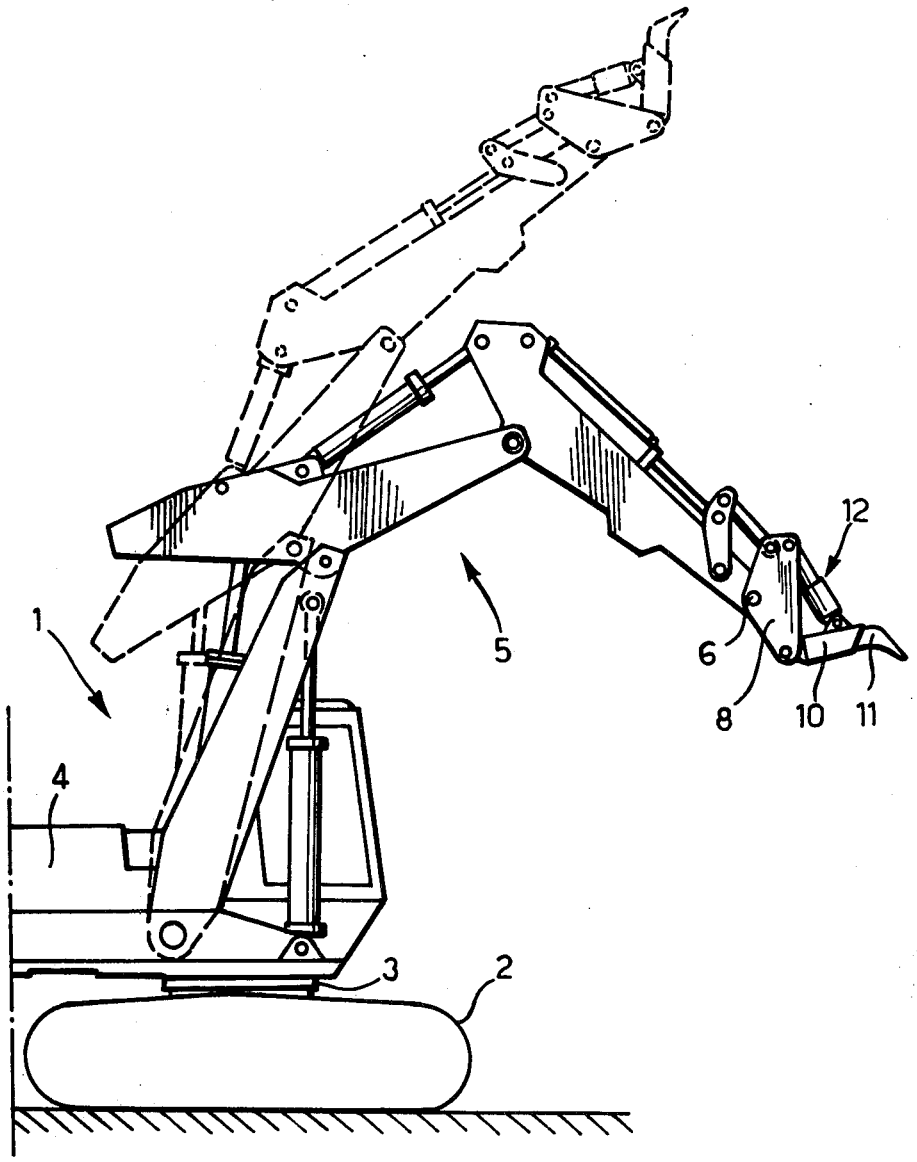
FIG. 2 is a side view of the machine shown in FIG. 1 illustrated in a working position.
Figure 3:
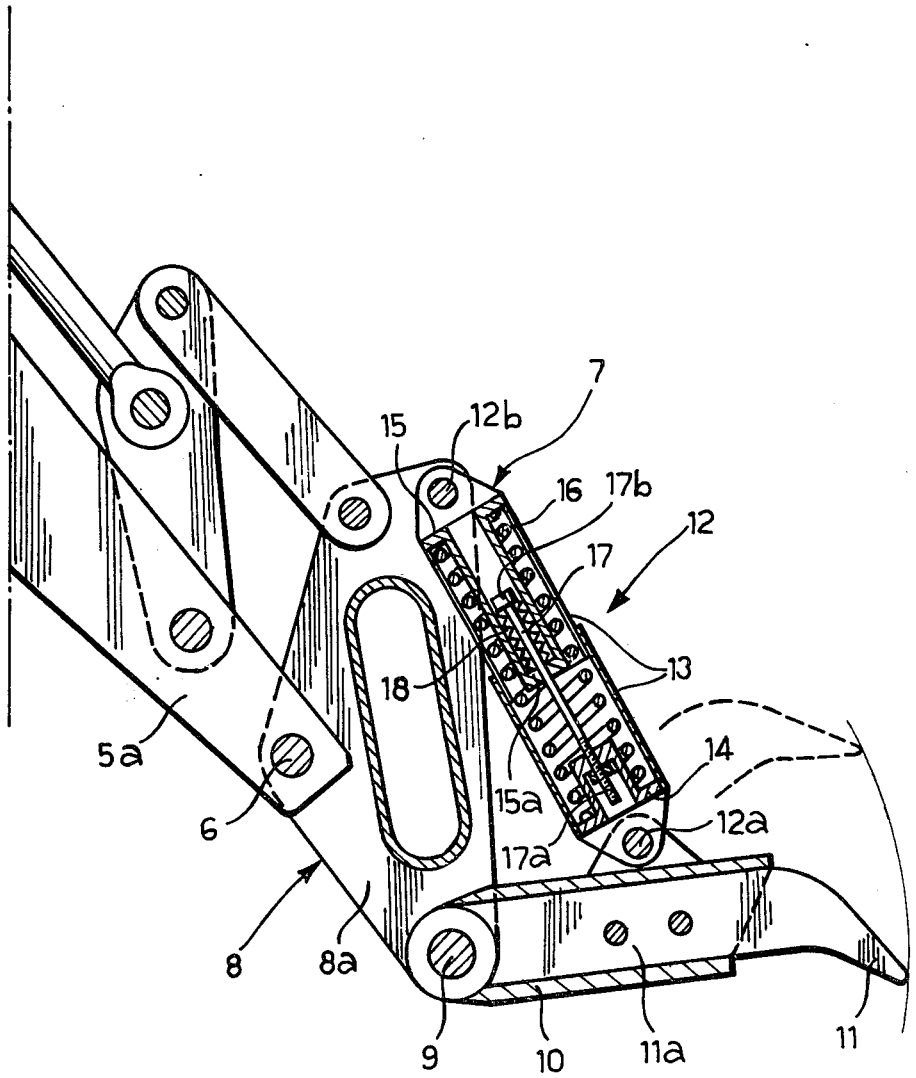
FIG. 3 is an enlarged detailed view of a portion of the machine as shown in FIG. 2.

Referring now to FIG. 1, there is shown an excavator machine 1 which is provided with a pair of endless crawler tracks 2. The crawler tracks 2 support a rigid framework 3 which is rotatable with respect to the crawler tracks 2 and upon which is mounted an enclosure 4. Articulated on the framework 3 is the base of a working arm 5 which has a free end 5*a* on which there is articulated a working implement 7, connected thereto by means of a pin 6, to scrape the walls and ceilings of vaults and tunnels in which the excavating equipment operates. The working implement or material excavating tool 7, best shown in detail in FIG. 3, is formed of a rigid support structure 8 formed by two parallel spaced and rigidly interconnected plates 8*a* only one of which is shown in FIG. 3. Three tubular elements 10 are each articulately connected to the lowermost portion of the support structure 8 about a pin 9. A scraping tool 11, having a body portion 11*a*, is carried within each tubular element 10.

In order to dissipate or absorb stresses occurring when the scraping tool 11 is impacted against a working surface, each tubular element 10 is connected to the upper portion of support structure 8 through a shock absorber or yieldable arm 12. The shock absorber 12 is connected to the tubular element 10 at articulated joint 12*a* and to the upper portion of support structure 8 at articulated joint 12*b*. Each of the shock absorbers 12 include an external casing 13, closed at both ends by bottom walls 14 and 15, and formed by two coaxial cylinders which slide telescopically relative to one another. A compression spring 16 is carried within the casing 13 and abuts the bottom walls 14 and 15 to spring bias the bottom walls 14 and 15 apart. The spring force of compression spring 16 provides a predetermined force preventing the tubular element 10 and scraping tool 11 from rotating relative to the support structure 8 unless a force is exerted on the tip of the tool 11 sufficient to overcome the biasing force of the spring 16. In this manner, during normal operation the scraping tool 11 is permitted to exert a force sufficient to dislodge loosened material. However, upon the occurrence of high stress impact, the spring force of compression spring 16 will be overcome permitting the tubular element 10 and scraping tool 11 to rotate thereby absorbing the impact.

Opposing the biasing action of compression spring 16 is a damping compression spring 18 which is positioned about an adjustable bolt 17 between the bolt head 17*b* and a facing section 15*a* of the wall 15. The damping compression spring 18 is formed by a plurality of elementary conical ring springs and has a rigidity considerably greater than that of the compression spring 16. The bolt 17 has a threaded end 17*a* which passes through the bottom wall 14 of the casing 13 to engage a threaded nut for adjusting the force of the damping compression spring 18.

Adjustment of the bolt 17 varies the force exerted by the damping compression spring 18, and thereby provides an adjustment to control the magnitude of the impact force exerted against the tip of the tool 11 which will be effective to compress the yieldable arm or shock absorber 12. In this manner, the yieldable arm or shock absorber 12 can be adjusted to allow the scraping tool 11 to operate in a normal manner being subjected to the forces normally encountered during scraping. However, upon the occurrence of excessive forces such as occur when the tip of the tool impacts against the solid structure, the scraping tool 11 will be rotated backward absorbing the impact load and preventing excessive stresses from being imposed on the working arm 5 or the excavator itself.

While the invention has been described with reference to a preferred embodiment it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. In a machine for excavating material and having a work arm supported at one end of a base and a material excavating tool pivotally connected at a free end of the work arm, the improvement comprising an impact absorbing compression spring carried within a pair of coaxial cylinders connected between said work arm and said pivotally connected material excavating tool and telescopically movable relative to each other to absorb an impact force exceeding a predetermined magnitude by moving said coaxial cylinders relative to each other thereby compressing said impact absorbing compression spring to absorb impact forces imparted to said excavating tool which exceed a predetermined magnitude, adjusting means operatively connected to said impact absorbing compression spring for adjusting said impact absorbing compression spring to determine the magnitude of the impact forces to be absorbed thereby, said adjusting means including a damping compression spring carried coaxially within said coaxial cylinders and said impact absorbing compression spring to exert a preloaded spring force on said coaxial cylinders in a direction opposed to the spring force exerted by said impact absorbing compression spring, said damping compression spring coaxially encircling a threaded support rod carried entirely within said coaxial cylinders, and secured to one of said coaxial cylinders, and operatively connected to said damping compression spring to vary the spring force exerted by said damping compression spring in opposition to the spring force exerted by said impact absorbing compression spring thereby determining the magnitude of the impact forces to be absorbed by said impact absorbing compression spring.

2. The apparatus of claim 1 wherein at least one of the ends of said coaxial cylinders is recessed inwardly and at least one of the ends of said threaded rod extends outwardly through said recessed cylinder end to facilitate varying the spring force exerted by said damping compression spring.

3. The apparatus of claim 2 wherein said damping compression spring is carried within the inwardly recessed end of said coaxial cylinder.

4. The apparatus of claim 2 wherein the recessed end of said coaxial cylinders extends inwardly within at least a portion of said impact absorbing compression spring.

* * * * *